United States Patent [19]

Hurst, Jr.

[11] 4,332,503

[45] Jun. 1, 1982

[54] APPARATUS FOR SIGNALING DIRECTION OF TRAVEL ON A ROAD BED

[76] Inventor: George H. Hurst, Jr., 16491 Harbour La., Huntington Beach, Calif. 92649

[21] Appl. No.: 805,296

[22] Filed: Jun. 10, 1977

[51] Int. Cl.[3] ..... E01F 13/00

[52] U.S. Cl. ..... 404/11; 49/131

[58] Field of Search ..... 404/11, 6, 9; 14/71.7, 14/69.5; 49/49, 131, 133

[56] References Cited

U.S. PATENT DOCUMENTS

| | | | |
|---|---|---|---|
| 1,649,877 | 11/1927 | Walston | 49/131 X |
| 2,075,892 | 4/1937 | Evans | 49/134 |
| 2,255,911 | 9/1941 | Burnison | 49/134 |
| 2,403,014 | 7/1946 | Nampa | 49/33 |
| 2,639,450 | 5/1953 | Ramer | 14/71.7 |
| 2,643,010 | 6/1953 | Hott | 14/69.5 X |
| 3,390,484 | 7/1968 | Gillespie | 49/131 |
| 3,748,782 | 7/1973 | Reynolds | 49/131 |

FOREIGN PATENT DOCUMENTS

| | | | |
|---|---|---|---|
| 307818 | 3/1933 | Italy | 49/131 |

*Primary Examiner*—Nile C. Byers, Jr.

*Attorney, Agent, or Firm*—Christie, Parker & Hale

[57] ABSTRACT

A ramp is pivotably mounted in a road bed transverse to the flow of traffic. The ramp pivots between a first position raised above the surface of the road bed and a second position approximately flush with the surface of the road bed, but preferably slightly raised therefrom. A spring biases the ramp to its second position, and applies a return force to the ramp when it pivots from its second, i.e., intermediate, position to a third, i.e., depressed, position substantially flush with the surface of the road bed. Responsive to traffic approaching the ramp from one direction, the ramp pivots from its intermediate position into its depressed position as the traffic passes over the ramp. Responsive to traffic approaching the ramp from the opposite direction, the ramp pivots from its intermediate position into its raised position as the traffic passes over the ramp to signal travel in the wrong direction. Specifically, a platform is pivotably mounted in the road bed adjacent to and after the ramp in the right direction flow. The platform pivots between an upper position substantially flush with the surface of the road bed and a lower position below the surface of the road bed. A spring biases the platform to its upper position and applies a return force to the platform when it pivots from its upper position to its lower position. The ramp and the platform are interconnected to pivot the ramp to its raised position when the platform pivots to its lower position, and to lock the platform in its upper position while the ramp is in its depressed position. The apparatus is housed by a container having a flanged open top covered by the ramp and the platform. Seals prevent moisture from entering the top of the container.

18 Claims, 9 Drawing Figures

APPARATUS FOR SIGNALING DIRECTION OF TRAVEL ON A ROAD BED

BACKGROUND OF THE INVENTION

This invention relates to vehicle traffic control and, more particularly, to apparatus for signaling the direction of vehicle travel on a road bed.

Many people are needlessly killed or injured each year by vehicles traveling in the wrong direction on a one-way street or highway. The problem usually begins when a confused motorist enters the exit roadway of a limited access highway, such as a freeway, an expressway, or a divided highway. Once traveling on the exit roadway in the wrong direction, the motorist soon finds himself on the limited access highway in the midst of traffic flowing counter to his direction of travel.

A number of those who have devoted attention to the problem of travel in the wrong direction on a one-way road have proposed installing a spring-loaded ramp in the road bed transverse to the flow of traffic. The ramp is mounted so a first end thereof pivots about a second end thereof. A spring biases the ramp so the first end pivots to a raised position in the absence of a load on the ramp, and pivots to a depressed position substantially flush with the surface of the road bed when loaded by a vehicle. Vehicles traveling in the right direction of traffic flow pass over the second end of the ramp before the first end, thereby pivoting the ramp to its depressed position. As a result, the vehicle is supposed to travel over the ramp without a noticeable disturbance. Vehicles traveling in the wrong direction of traffic flow pass over the first end of the ramp before the second end, which maintains the first end of the ramp in its raised position while the vehicle passes over. As a result, the ramp imparts a sharp jolt to the vehicle, which alerts the driver that he is traveling in the wrong direction.

The described spring-loaded ramp has not found wide acceptance as a traffic control device. The maintenance of the ramp in its raised position in the absence of a load, itself creates a potential traffic hazard. First, small light vehicles, such as motorcycles, traveling over the ramp in the right direction of traffic flow may fail to provide a sufficient load to pivot the ramp to its depressed position. In such case, the ramp serves to catapult the vehicle from its first end out of contact with the road surface, which raises the risk of the driver losing control of his vehicle. Second, drivers unaccustomed to the ramp may be alarmed by its presence in front of them, which also raises the risk of the driver losing control of his vehicle.

SUMMARY OF THE INVENTION

According to the invention, a ramp is movably mounted in a road bed transverse to the flow of traffic. The ramp is movable between a first position raised substantially above the surface of the road bed, and a second position approximately flush with the surface of the road bed. The ramp is biased into its second position, i.e., approximately flush with the surface of the road bed. Responsive to traffic approaching the ramp from one direction, e.g., the right direction of traffic flow, the ramp is prevented from moving into its first, i.e., raised position. Thus, the ramp does not create a risk of loss of vehicle control as the vehicle passes over the ramp. Responsive to traffic approaching the ramp from the opposite direction, e.g., the wrong direction of traffic flow, the ramp moves into its first, i.e., raised, position as the traffic passes over the ramp. Thus, a sharp jolt is imparted to the vehicle to signal the driver that he is traveling in the wrong direction.

As a feature of the invention, the ramp is biased by a spring into the second position, which is raised slightly above the surface of the road bed, and is pivotable into a third position substantially flush with the surface of the road bed. When the ramp is in its third position, the spring provides a force to return the ramp to its second position. Responsive to movement of the ramp from its second position to its third position, the means for moving the ramp into its raised position is disabled, thereby discriminating between the two directions.

In the preferred embodiment, a platform is movably mounted in the road bed adjacent to and after the ramp in the flow of traffic in the right direction. The platform is movable between an upper position substantially flush with the surface of the road bed and a lower position below the surface of the road bed. A spring biases the platform to its upper position and applies a return force to the platform when it moves from its upper position to its lower position. An interconnection between the ramp and the platform moves the ramp to its first position when the platform pivots under the weight of a vehicle to its lower position and locks the platform in its upper position while the ramp is in its third position, so the weight of a vehicle on the platform does not raise the ramp to its first position.

BRIEF DESCRIPTION OF THE DRAWINGS

The features of specific embodiments of the best mode contemplated of carrying out the invention are illustrated in the drawings, in which.

DETAILED DESCRIPTION OF SPECIFIC EMBODIMENTS

Figure 1:
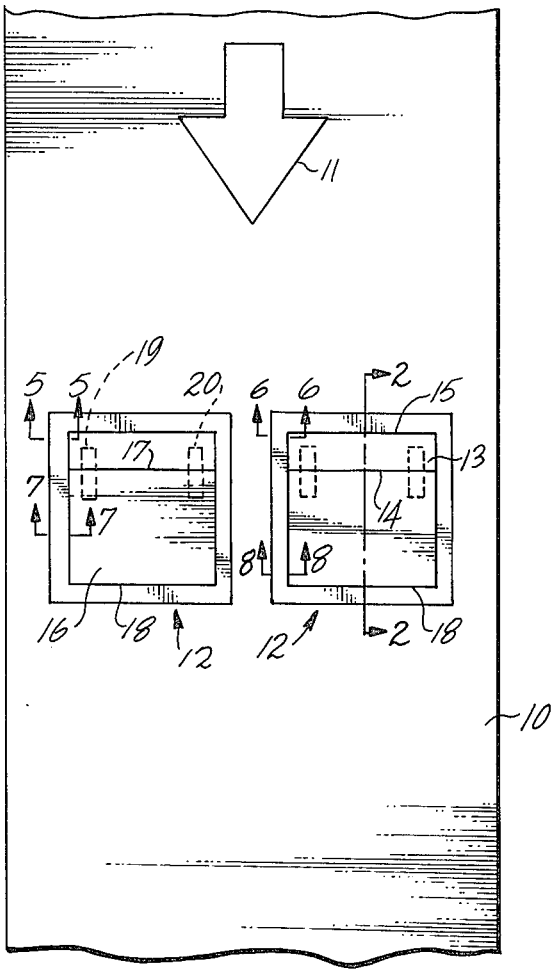
FIG. 1 is a top plan view of a road bed in which apparatus incorporating the principles of the invention is installed.

In FIG. 1, the right direction of traffic flow on a one way road bed 10 is designated by an arrow 11. A pair of direction detecting devices 12 are disposed in road bed 10 transverse to the flow of traffic so all traffic must travel over one or both of devices 12. Devices 12 each include a ramp 13 having ends 14 and 15 transverse, and preferably perpendicular, to traffic flow and a platform 16 having ends 17 and 18 transverse, and preferably perpendicular, to traffic flow. End 15 of ramp 13 is before end 14 in the right direction of traffic flow. Ramp 13 is mounted so end 14 pivots about end 15. End 14 of ramp 13 is biased into an intermediate position approximately flush with, but preferably raised slightly from the surface of road bed 10, and is pivotable into a depressed position substantially flush with the surface of road bed 10. End 17 of platform 16 is adjacent to end 14 of ramp 13. End 18 is after end 17 in the right direction of traffic flow. Platform 16 is mounted so end 17 pivots about end 18. End 17 of platform 16 is biased into an upper position substantially flush with the surface of road bed 10 and is pivotable into a lower position below the surface of road bed 10. Each of devices 12 has a pair of interconnections 19 and 20 between ramp 13 and platform 16 on opposite sides of device 12. Typically, ramp 13 would have a length of the order of one foot and a width of the order of four feet, platform 16 would have a length of the order of three feet and a width of the order of four feet.

In the absence of traffic passing over device 12, end 17 of platform 16 is biased into its upper position, and end 14 of ramp 13 is biased into its intermediate position, which is typically of the order of one-half inch above the surface of road bed 10. When traffic approaches ramp 13 in the right direction, i.e., in the direction of arrow 11, the weight of the vehicle on ramp 13 pivots end 14 into its depressed position. Responsive to such pivoting of ramp 13, interconnections 19 and 20 lock platform 16 in its upper position so platform 16 will not pivot to its lower position as the traffic passes thereover. When traffic approaches ramp 13 in the wrong direction, i.e., in the direction opposite arrow 11, the weight of the vehicle on platform 16 pivots end 17 of platform 16 to a lower position, which is typically of the order of two to four inches below the surface of road bed 10. Responsive to such pivoting, interconnections 19 and 20 pivot end 14 of ramp 13 to a raised position substantially above the surface of road bed 10, typically of the order of four to six inches above the surface of road bed 10. Consequently, a height differential of six to ten inches is created between end 14 of ramp 13 and end 17 of platform 16. This differential sharply jolts the vehicle passing over devices 12 and thereby alerts the driver to the fact he is moving counter to the direction of traffic flow. Of course, the height of end 14 of ramp 13 above the surface of road bed 10 in its raised position, the depth of end 17 of platform 16 in its lower position, and the ratio of this height to this depth can be varied to suit the circumstances by modifying the design of interconnections 19 and 20.

Figure 2:
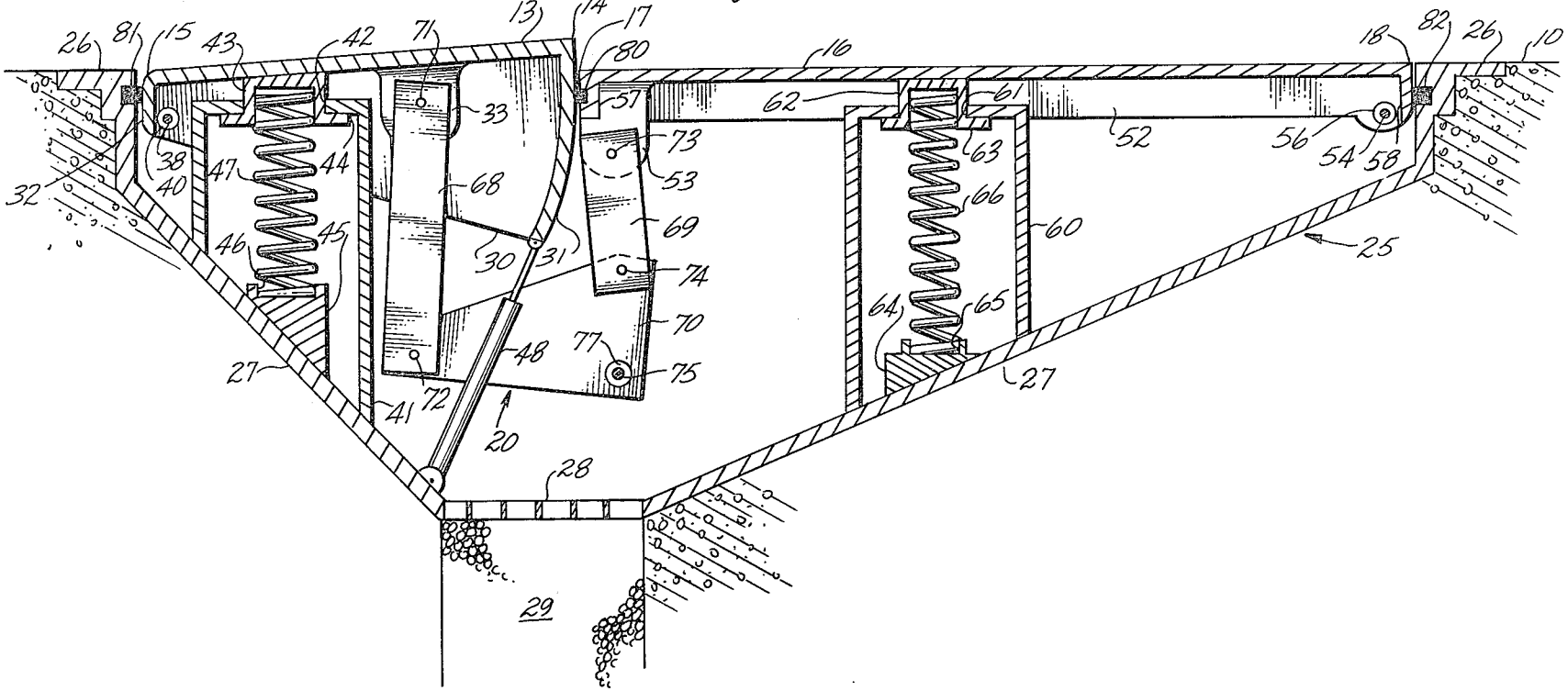
FIG. 2 is a side sectional view of the apparatus of FIG. 1.

As depicted in FIG. 2, each of devices 12 is housed in a noncorrosive metal container 25 having an open top with an edge flange 26 mounted flush with the surface of road bed 10. Devices 12 could easily be installed in an existing roadway by simply cutting a hole large enough to hold container 25 in the road bed, placing container 25 therein, and securing flange 26 to the road bed. Ramp 13 and platform 16 cover the open top of container 25. Container 25 has sides 27 that slope toward a grate 28 at the bottom of container 25. Gravel 29 is located under grate 28. As a result, water that enters container 25 drains through grate 28 to prevent water from settling in container 25.

Figure 5:
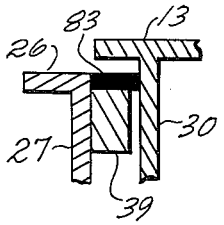
FIG. 5 is a front sectional view of one of the ramps of FIG. 1 illustrating its side seal.
Figure 6:
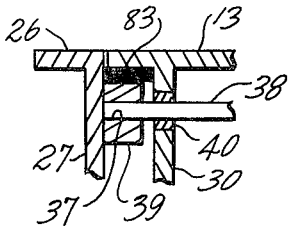
FIG. 6 is a front sectional view of one of the ramps of FIG. 1 illustrating the shaft on which the ramp is pivotably mounted.

Integral with ramp 13 are a pair of vertical side walls 30 inwardly spaced from the side edges of ramp 13 (FIG. 5), an arcuate front wall 31 extending downwardly from end 14, a vertical rear wall 32 extending downwardly from end 15, and a pair of linkage attaching arms 33. The ends of a stationary shaft 38 fit in bores 37 formed in a pair of blocks 39 (FIG. 6) attached by means such as welding to the inside of container 25 along the sides of ramp 13 below the surface of road bed 10. Blocks 39 also serve as stops on the pivoting motion of end 14 of ramp 13. Thus, when the side edges of ramp 13 rest on blocks 39, ramp 13 is flush with the surface of road bed 10. Side walls 30 are journaled by bearings 40 for rotation about shaft 38. Thus, ramp 13 is mounted so end 14 pivots about end 15. A bracket 41 is attached to side wall 27 by means such as welding. The top of bracket 41 has an opening 42 into which a cap 43 slidably fits. An annular flange 44 is formed on the end of cap 43. A spring keeper 45, which is attached to side wall 27 by means such as welding, has a recess 46 in which one end of a compression spring 47 fits. The other end of compression spring 47 fits into cap 43. Spring 47 is maintained in compression between cap 43 and recess 46. In the absence of a load on ramp 13, spring 47 urges flange 44 up against bracket 41 to pivot end 14 of ramp 13 into its intermediate position, as shown in FIG. 2. When a load is applied to ramp 13 while end 14 is in its intermediate position, spring 47 is further compressed and cap 43 slides downwardly through opening 42, until end 14 of ramp 13 pivots to its depressed position. When the load is removed from ramp 13, spring 47 returns end 14 of ramp 13 to its intermediate position. The spring constant of spring 47 is relatively small. Typically, a load of 10 or 15 pounds on ramp 13 would be sufficient to depress spring 47 sufficiently to pivot ramp 13 from its intermediate position to its depressed position.

Figure 7:
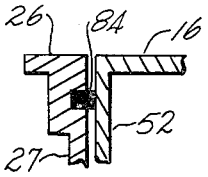
FIG. 7 is a front sectional view of one of the platforms of FIG. 1 illustrating its side seal.

Integral with platform 16 are a pair of vertical side walls 52 along the side edges of platform 16 (FIG. 7), a pair of linkage attaching arms 53 in the same vertical plane as arms 33 of ramp 13, a vertical front wall 57 extending downwardly from end 17, and a vertical rear wall 58 extending downwardly from end 18. The ends of a stationary shaft 54 fit in bores 55 (FIG. 8) formed in opposite side walls 27. Side walls 52 are journaled by bearings 56 for rotation about shaft 54. Thus, platform 16 is mounted so end 17 pivots about end 18. A bracket 60 is attached to side wall 27 by means such as welding. The top of bracket 60 has an opening 61. An end cap 62, which has an annular flange 63, slidably fits in opening 61. A spring keeper 64, which is attached to side wall 27 by means such as welding, has a recess 65 in which one end of a compression spring 66 fits. The other end of compression spring 66 fits in end cap 62. Spring 66 is maintained in compression between end cap 62 and recess 65. In the absence of a load on platform 16, spring 66 urges flange 63 up against bracket 60 to bias end 17 of platform 16 into its upper position. When a load is applied to platform 16, while end 14 of ramp 13 is in its intermediate position as shown in FIG. 2, end cap 62 slides downwardly through opening 61 to further compress spring 66 as end 17 of platform 16 pivots to its lower position. When the load is removed from platform 16, spring 66 returns end 17 of platform 16 to its upper position. Spring 66 has a smaller spring constant than spring 47. Typically, a load of the order of five pounds would be sufficient to depress spring 66 sufficiently to pivot platform 16 to its lower position.

Ramp 13 and platform 16 are both preferably cast from a light material such as aluminum to reduce the weight of the moving parts of devices 12 and minimize their enertia, which shortens the cycle time thereof and speed of response to moving vehicles. The tops of ramp 13 and platform 16 are provided with anti-skid surfaces, such as a vulcanized rubber layer, an expanded metal sheet welded in place, or a silicon carbide impregnation.

Figure 8:
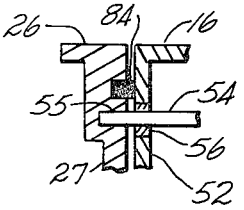
FIG. 8 is a front sectional view of one of the platforms of FIG. 1 illustrating the shaft on which the platform is pivotably mounted.

As shown in FIG. 2 for interconnection 20, interconnections 19 and 20 each comprise a linkage 68, a linkage 69, and a bell crank 70. One end of linkage 68 is pivotably connected to arm 33 by a pin 71, and the other end of linkage 68 is pivotably connected to bell crank 70 by pin 72. One end of linkage 69 is pivotably connected to arm 53 by a pin 73, and the other end of linkage 69 is pivotably connected to bell crank 70 by a pin 74. A stationary shaft 75 is secured to side wall 27 in the same manner as shaft 54 (FIG. 8). At a point between pins 72 and 74, bell crank 70 is journaled by a bearing 77 for rotation about shaft 75.

In the absence of a load on ramp 13 or platform 16, end 14 of ramp 13 is in its intermediate position, and end 17 of platform 16 is in its upper position as shown in FIG. 2. Pins 71 and 72 are disposed on one side of shaft 75 to exert a counterclockwise torque on bell crank 70, as viewed in FIG. 2, when a load is applied to ramp 13. Pins 73 and 74 are disposed on the other side of shaft 75 to exert a clockwise torque on bell crank 70, as viewed in FIG. 2, when a load is applied to platform 16.

Figure 3:
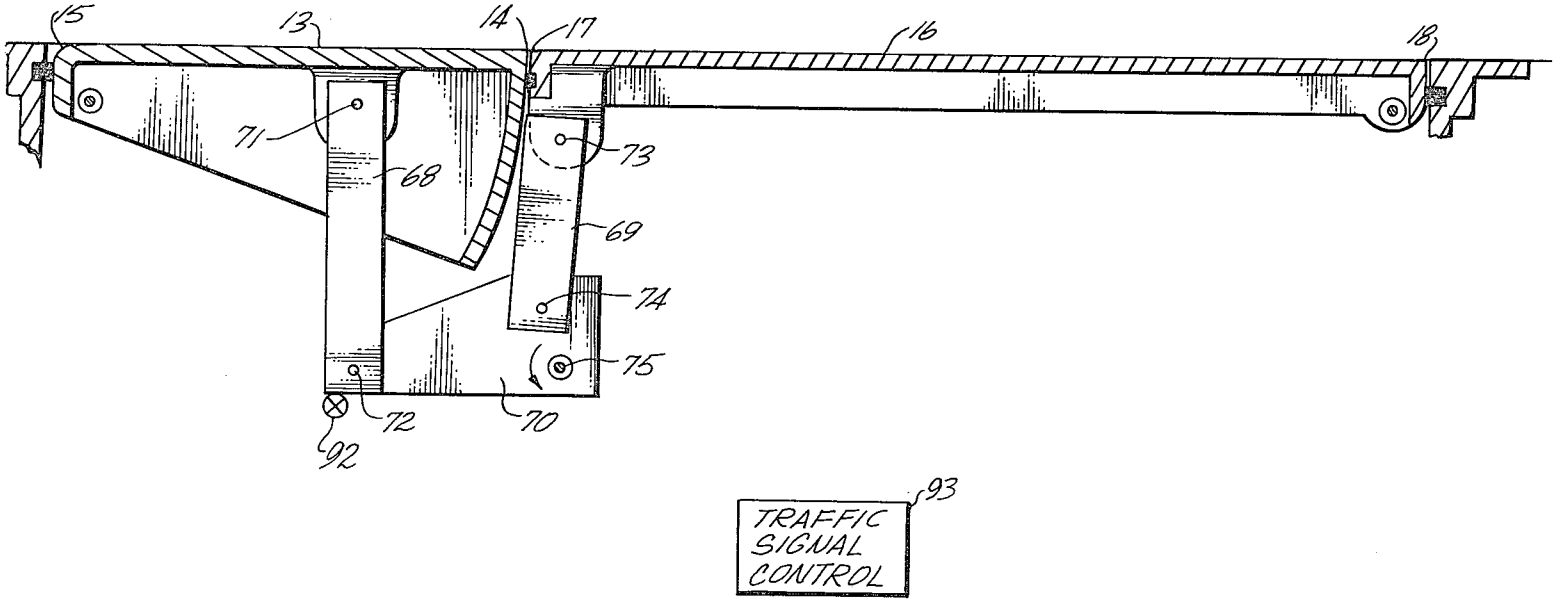
FIG. 3 is a side sectional view of the principal components of FIG. 2 during vehicle travel on the road bed in the right direction.

When a vehicle travels in the right direction of traffic flow, i.e., from left to right in FIG. 2, a load is applied to ramp 13 prior to platform 16. This load pivots end 14 of ramp 13 to its depressed position and exerts a counterclockwise torque on bell crank 70, which rotates pin 74 until pins 73 and 74 are overcenter of shaft 75, as depicted in FIG. 3. As used herein, the term "overcenter" means that the pins of the linkage are either aligned with the pivot point of bell crank 70, i.e., shaft 75, so a load applied to the linkage does not exert a torque on bell crank 70, or disposed on the opposite side of the pivot point of bell crank 70 so a load applied to the linkage exerts a torque on bell crank 70 in the direction which tends to hold the linkage in place as the load is applied thereto. Preferably, the pins of the linkage are disposed slightly to the opposite side of the pivot point of bell crank 70 to insure establishment and maintenance of the overcenter condition. Thus, responsive to the pivoting of ramp 13 from its intermediate position to its depressed position, platform 16 becomes locked in its upper position. As the vehicle travels from ramp 13 to platform 16, platform 16 remains flush with the surface of road bed 10. The driver sees only a relatively flat plate in his path and no noticeable disturbance of the vehicle takes place. When the vehicle leaves platform 16 at end 18, the force of spring 47 returns ramp 13 to its intermediate position, which rotates pins 73 and 74 of linkage 69 out of the overcenter condition to the original condition illustrated in FIG. 2.

Figure 4:
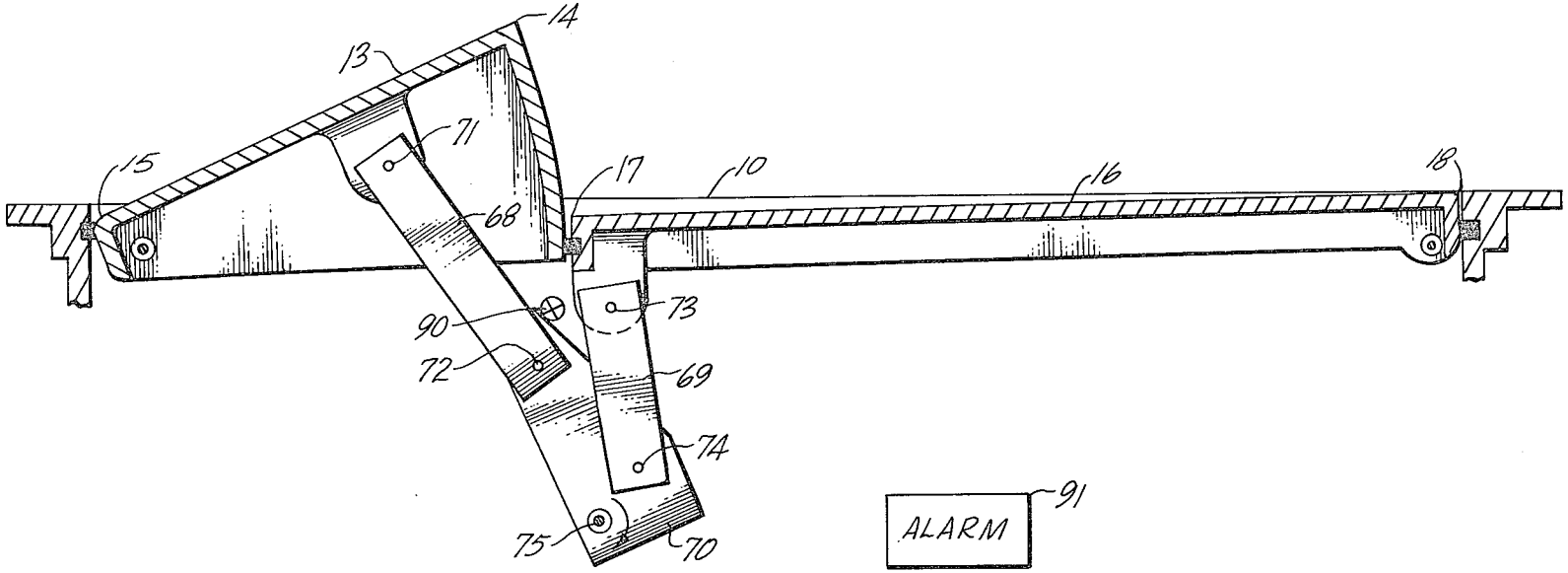
FIG. 4 is a side sectional view of the principal components of FIG. 2 during vehicle travel on the road bed in the wrong direction.

When a vehicle travels in the wrong direction of traffic flow, i.e., from right to left in FIG. 2, a load is applied to platform 16 prior to ramp 13. This load pivots end 17 of platform 16 to its lower position and exerts a clockwise torque on bell crank 70. As a result, end 14 of ramp 13 is pivoted to its raised position by linkage 68. Preferably, as depicted in FIG. 4, pins 71 and 72 are overcenter of shaft 75 when ramp 13 is in its raised position. This holds ramp 13 in its raised position until the vehicle leaves ramp 13. The lowering of end 17 of platform 16 and the raising of end 14 of ramp 13 creates a step that sharply jolts the vehicle as it travels from platform 16 to ramp 13. This jolt unmistakenly signals to the driver of the vehicle that he is traveling in the wrong direction. The top of bracket 60 serves as a limit on the downward pivoting of end 17 of platform 16 and also on the upward pivoting of end 14 of ramp 13 by virtue of interconnections 19 and 20. After the vehicle leaves ramp 13 at end 15, spring 66 returns end 17 of platform 16 to its upper position and rotates linkage 68 out of its overcenter condition so end 14 of ramp 13 is able to return to its intermediate position, as illustrated in FIG. 2.

A shock absorber 48 (FIG. 2) is connected between ramp 13 and side wall 27 to eliminate rattling and dampen the movement, particularly the upward pivoting, of ramp 13 during operation of device 12.

The primary element of the invention is ramp 13, which normally is approximately flush with the surface of road bed 10 to present little or no disturbance to vehicles traveling in the right direction of traffic flow; when vehicle travel in the wrong direction is sensed, this ramp raised up to disturb the travel of such vehicle. In the disclosed embodiment of the invention, platform 16 serves to sense vehicle travel in the wrong direction and to raise up ramp 13 by virtue of interconnections 19 and 20. However, these functions could be performed by other mechanical or even electronic means. For example, the wrong direction of travel could be sensed by radar or by a pair of pressure actuated switches arranged in the flow of traffic so that switches are actuated in a particular sequence, and ramp 13 could be raised by a motor responsive to the electronic sensor. The use of platform 16 to sense vehicle travel in the wrong direction does, however, have the advantage of mechanical simplicity and increasing the intensity of the disturbance, because platform 16 drops as ramp 13 raises up. The functions of the pivoting of ramp 13 from its intermediate position to its depressed position are to sense vehicle travel in the right direction and to provide the mechanical motion, in such case, to lock platform 16 in its upper position, i.e., to disable the means for raising ramp 13. If these functions are performed in some other way such as electronically, the intermediate position of ramp 13 could be eliminated; in other words, ramp 13 could be substantially flush with the surface of road bed 10, i.e., in its depressed position, in the absence of a load thereon.

Blocks 39 (FIG. 5) serve as stops on the downward pivoting of ramp 13, thereby defining the depressed position thereof. By virtue of interconnections 19 and 20, this also serves as a stop on the overcenter movement of pins 73 and 74 and the upward pivoting of platform 16, thereby defining the upper position thereof. The top surface of bracket 60 serves as a stop on the downward pivoting of platform 16, thereby defining the lower position thereof. By virtue of interconnections 19 and 20, this also serves as a stop on the overcenter movement of pins 71 and 72 and the upward pivoting of ramp 13, thereby defining the raised position thereof.

The faster the vehicle speed and the smaller the vehicle weight, the longer the platform 16 must be to properly perform its function and respond to vehicles traveling thereover in timely fashion.

Device 12 is completely sealed to prevent water from entering container 25. Specifically, a seal 80 (FIG. 2) is retained in a groove formed in front wall 57 of platform 16. As end 14 of ramp 13 or end 17 of platform 16 pivot, seal 80 engages front wall 31 of ramp 12 to seal the interface between ramp 13 and platform 16. Similarly, a seal 81 is retained in a groove in side wall 27 at the front of container 25, and a seal 82 is retained in a groove in side wall 27 at the back of container 25. As ramp 13 and platform 16 pivot, seals 81 and 82 engage back wall 32 and back wall 58, respectively, and thus seal the nonadjacent ends of ramp 13 and platform 16, i.e., ends 15 and 18. A seal 83 is secured to the top of block 39 (FIGS. 5 and 6) to engage side walls 30 and thus seal the sides of ramp 13 and cushion ramp 13 as it pivots to its depressed position during traffic flow in the right direction. A seal 84 is retained in a groove in side wall 27 along the sides of container 25 adjacent to platform 16 (FIGS. 7 and 8) to engage side walls 52 and thus seal the sides of platform 16.

Figure 9:
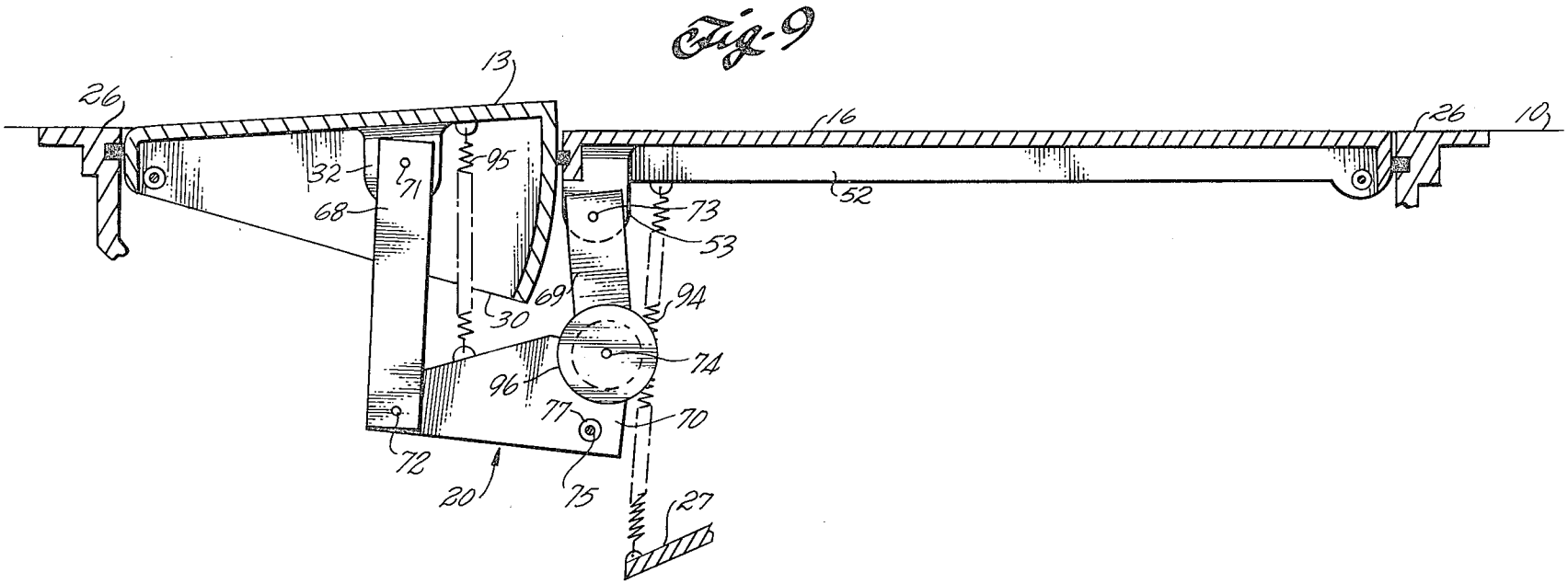
FIG. 9 is a side sectional view of an alternative embodiment of the apparatus of FIG. 1.

In FIG. 9 is shown an embodiment of the invention in which a pair of tension springs 94 and a pair of tension spring 95 are employed to reduce rattling and wear between pins 71 through 74 and shaft 75 and the holes in which they fit. Each tension spring 94 is connected between one of side walls 52 and side wall 27 so as to extend in close proximity to pin 74. Each tension spring 95 is connected between ramp 13 and one of bell cranks 70. As a result, during operation of device 12, pins 71 through 74 and shaft 75 are maintained by springs 94 and 95 against one side of the respective holes in which they fit, thereby preventing repeated back and forth movement within such holes, which would result in rattling and excessive wear. In this embodiment, spring 94 also serves as a substitution for spring 66 in the embodiment of FIG. 2. A pulley 96 is mounted on each pin 74. When platform 16 is in its upper position, spring 94 rests lightly in the groove of pulley 96. When platform 16 pivots to its lower position as a load is applied thereto, pulley 96 pivots in a clockwise direction as viewed in FIG. 9, and thereby extends spring 94. When the load is removed from platform 16, spring 94 urges pulley 96 in a counterclockwise direction, thereby returning platform 16 to its upper position. As with spring 66, spring 94 has a smaller spring constant than spring 47.

In addition to signaling to the driver of a vehicle that he is traveling in the wrong direction, the disclosed apparatus could be used to trigger a visual or audible alarm when a vehicle travels in the wrong direction. This could be done by providing a pressure actuated microswitch 90 (FIG. 4) in the clockwise path of travel of bell crank 70. As ramp 13 pivots to its raised position, microswitch 90 actuates an alarm 91 such as a warning light to alert drivers in the right direction. At the exit of a limited access highway, travel of vehicles in the right direction could be used to trip a traffic light control 93 by means of a pressure actuated microswitch 92 (FIG. 3) in the counterclockwise path of travel of bell crank 70. The invention could also be used as a traffic counter to separately count the vehicles traveling in one or both directions of traffic flow; microswitches 90 and 92 trigger separate counters for this purpose. The invention could further be used as a device to hold vehicles parked on a hill; the vehicle backs up against end 14 of ramp 13, where it is held until it is driven away in the direction of end 18 of platform 16. The invention could also be used to signal illegal entrance through the exit of a parking lot or a private entrance.

The described embodiments of the invention are only considered to be preferred and illustrative of the inventive concept; the scope of the invention is not to be restricted to such embodiments. Various and numerous other arrangements may be devised by one skilled in the art without departing from the spirit and scope of this invention. For example, the ramp could be lowered rather than raised to present a disturbance to vehicles traveling in the wrong direction; in this case, the ramp would normally be approximately flush with the surface of the road bed and would form a rut responsive to sensing of vehicle travel in the wrong direction. Further, although it is preferable to pivotably mount the ramp and platform, they could be mounted so as to provide other types of motion such as translational motion normal to the surface of the road bed.

A plurality of devices 12 could be arranged in series along a road bed, each with ramps that are raised successively higher, e.g, 2 inches, 4 inches, and 6 inches, to gradually increase the intensity of the disturbance and finally to disable the vehicle traveling in the wrong direction.

What is claimed is:

1. Apparatus for signaling travel on a road bed counter to the flow of traffic, the apparatus comprising:

a ramp;

means for movably mounting the ramp in the road bed transverse to the flow of traffic, the ramp being movable between a first position raised substantially above the surface of the road bed and a second position approximately flush with the surface of the road bed;

means for biasing the ramp into its second position;

means responsive to traffic approaching the ramp from one direction for preventing movement of the ramp toward its first position as the traffic passes over the ramp; and means responsive to traffic approaching the ramp from the opposite direction for moving the ramp into its first position as traffic passes over the ramp.

2. The apparatus of claim 1, in which the ramp has a first end, and a second end before the first end in the flow of traffic in the one direction, and the mounting means pivots the first end about the second end.

3. The apparatus of claim 2, in which the means for moving the ramp into its raised position comprises:

a platform;

means for movably mounting the platform in the road bed adjacent to and after the ramp in the flow of traffic in the one direction, the platform being movable between an upper position substantially flush with the surface of the road bed and a lower position below the surface of the road bed;

means for biasing the platform to its upper position and applying a return force to the platform when it moves from its upper position to its lower position; and means interconnecting the ramp and the platform for moving the ramp to its raised position when the platform moves to its lower position.

4. The apparatus of claim 3, in which the platform has a first end adjacent to the first end of the ramp and a second end after the first end of the platform in the flow of traffic in the one direction, and the platform mounting means pivots the first end of the platform about the second end of the platform.

5. The apparatus of claim 4, in which the ramp is movable to a third position below the second position, the second position being raised slightly above the surface of the road bed and the third position being substantially flush with the surface of the road bed, the means for biasing the ramp into its second position comprises spring means for biasing the ramp to the second position and applying a return force to the ramp when it moves from its second position to its third position;

and the means for preventing movement of the ramp comprises means interconnecting the ramp and the platform for locking the platform in its upper position while the ramp is in its third position.

6. A road device for detecting direction of travel on a road bed, the device comprising:

a ramp having first and second ends;

means for mounting the ramp in the road bed so its first end pivots about its second end, the first end of the ramp being pivotable between a raised position substantially above the surface of the road bed, and a depressed position substantially flush with or below the surface of the road bed;

spring means for biasing the first end of the ramp to an intermediate position between its raised and depressed positions and applying a return force to the first end of the ramp when it pivots from its intermediate position to its depressed position;

means responsive to travel of a load in the direction from the first end of the ramp to the second end of the ramp for pivoting the ramp to its raised position before the load reaches the ramp; and means responsive to pivoting of the ramp from its intermediate position to its depressed position for disabling the means for pivoting the ramp to its raised position.

7. A road device for detecting direction of travel on a road bed, the device comprising:

a ramp having first and second ends;

means for mounting the ramp in the road bed so its first end pivots about its second end, the first end of the ramp being pivotable between a raised position substantially above the surface of the road bed and a depressed position substantially flush with the surface of the road bed;

a platform having first and second ends;

means for mounting the platform in the road bed so its first end pivots about its second end and is adjacent to the first end of the ramp, the first end of the platform being pivotable between an upper position substantially flush with the surface of the road bed and a lower position below the surface of the road bed;

spring means for biasing the first end of the ramp to an intermediate position between its raised and depressed positions and applying a return force to the first end of the ramp when it pivots from the intermediate position to the depressed position;

spring means for biasing the first end of the platform to its upper position and applying a return force to the first end of the platform when it pivots from its upper position to its lower position; and means interconnecting the ramp and the platform for pivoting the first end of the ramp to its raised position when the first end of the platform pivots to its lower position and for locking the first end of the platform in its upper position while the first end of the ramp is in its depressed position.

8. The road device of claim 7, in which the interconnecting means comprises:

a first linkage;

means for pivotably connecting one end of the first linkage to the ramp;

a second linkage;

means for pivotably connecting one end of the second linkage to the platform;

a bell crank;

means for pivotably connecting the other end of the first linkage to the bell crank;

means for pivotably connecting the other end of the second linkage to the bell crank; and means for supporting the bell crank for rotation about an axis between the means for pivotably connecting the other end of the first linkage and the means for pivotably connecting the other end of the second linkage;

the first linkage rotating the bell crank in one direction and the means for pivotably connecting the ends of the second linkage moving overcenter of the axis of rotation of the bell crank to lock the platform when the first end of the ramp pivots from its intermediate position to its depressed position;

the second linkage rotating the bell crank in the opposite direction to pivot the first end of the ramp to its raised position when the first end of the platform pivots from its upper position to its lower position.

9. The road device of claim 8, in which the second linkage rotates the bell crank until the means for pivotably connecting the ends of the first linkage move overcenter of the axis of rotation of the bell crank to lock the first end of the ramp in its raised position when the first end of the platform pivots from its upper position to its lower position.

10. The road device of claim 7, additionally comprising a container having an open top, the ramp mounting means and the platform mounting means mounting the ramp and the platform to cover the open top of the container.

11. The road device of claim 10, additionally comprising means for sealing the edges of the open top of the container, the ramp, and the platform.

12. The road device of claim 11, in which the open top of the container has an edge flange mounted flush with the surface of the road bed.

13. The road device of claim 8, additionally comprising a tension spring connected between the ram and the bell crank to urge the ramp, the first linkage, and the bell crank together.

14. The road device of claim 13, in which the spring means for biasing the platform comprises a second tension spring connected between the platform and the road bed and a pulley having a groove across which the second tension spring passes, the pulley being mounted on the interconnecting means to bend and lengthen the second tension spring when the platform pivots from its upper position to its lower position, thereby applying a return force to the pulley, the second tension spring urging the platform, the second linkage, and the bell crank together.

15. The road device of claim 8, in which the spring means for biasing the platform comprises a tension spring connected between the platform and the road bed and means mounted on the interconnecting means across which the tension spring passes to bend and lengthen the tension spring when the platform pivots from its upper position to its lower position, thereby applying a return force to the interconnecting means, the spring urging the platform, the second linkage, and the bell crank together.

16. The road device of claim 8, additionally comprising a tension spring connected between the platform and the road bed to urge the platform, the second linkage, and the bell crank together.

17. Apparatus for signaling travel on a road bed counter to the flow of traffic, the apparatus comprising:

a ramp;

means for removably mounting the ramp in the road bed transverse to the flow of traffic, the ramp being movable between a first position spaced substantially from the surface of the road bed and a second position approximately flush with the surface of the road bed;

means for biasing the ramp into its second position;

means responsive to traffic approaching the ramp from one direction for preventing movement of the ramp toward its first position as the traffic passes over the ramp; and means responsive to traffic approaching the ramp from the opposite direction for moving the ramp into its first position as the traffic passes over the ramp.

18. The road device of claim 15, in which the means mounted on the interconnecting means is a pulley having a groove across which the tension spring passes.

* * * * *

UNITED STATES PATENT AND TRADEMARK OFFICE

CERTIFICATE OF CORRECTION

PATENT NO. : 4,332,503

DATED : June 1, 1982

INVENTOR(S) : George H. Hurst, Jr.

It is certified that error appears in the above-identified patent and that said Letters Patent are hereby corrected as shown below:

Column 6, line 18 "raised" should read --raises--;
line 26, "that" should read --the--;

Column 10, line 39 "ram" should read --ramp--.

Signed and Sealed this

Eighth Day of March 1983

[SEAL]

Attest:

GERALD J. MOSSINGHOFF

Attesting Officer

Commissioner of Patents and Trademarks